US007018177B2

(12) United States Patent
Feher

(10) Patent No.: US 7,018,177 B2
(45) Date of Patent: Mar. 28, 2006

(54) IMPELLER LOCK ASSEMBLY AND METHOD

(75) Inventor: Timothy A. Feher, Belle Vernon, PA (US)

(73) Assignee: Elliott Company, Jeannette, PA (US)

( * ) Notice: Subject to any disclaimer, the term of this patent is extended or adjusted under 35 U.S.C. 154(b) by 92 days.

(21) Appl. No.: 10/807,847

(22) Filed: Mar. 24, 2004

(65) Prior Publication Data

US 2005/0214125 A1 Sep. 29, 2005

(51) Int. Cl.
*F04D 29/34* (2006.01)

(52) U.S. Cl. ..... 416/204 A; 416/244 R

(58) Field of Classification Search ..... 416/204 R, 416/204 A, 244 A, 244 B, 244 R; 415/216.1
See application file for complete search history.

(56) References Cited

U.S. PATENT DOCUMENTS

| | | | | |
|---|---|---|---|---|
| 2,526,751 | A | 10/1950 | Hanns | |
| 2,892,646 | A | 6/1959 | Doble | |
| 2,960,939 | A | 11/1960 | Buschhorn et al. | |
| 3,061,342 | A | 10/1962 | Feller | |
| 3,131,956 | A | 5/1964 | Bailey | |
| 3,246,607 | A * | 4/1966 | James | 416/2 |
| 3,387,768 | A | 6/1968 | Zoehfeld | |
| 3,531,216 | A | 9/1970 | Callahan | |
| 3,642,383 | A | 2/1972 | Andvig | |
| 3,715,176 | A | 2/1973 | Kerklo | |
| 3,884,595 | A | 5/1975 | Herrick | |
| 4,053,261 | A * | 10/1977 | Pennig | 416/244 A |
| 4,363,603 | A | 12/1982 | Petersen | |
| 4,767,233 | A | 8/1988 | Erickson et al. | |
| 4,915,589 | A | 4/1990 | Gessler et al. | |
| 4,986,733 | A * | 1/1991 | Fleury et al. | 415/230 |
| 5,147,144 | A | 9/1992 | Kasai | |
| 5,163,816 | A | 11/1992 | Goetzke et al. | |
| 5,961,246 | A | 10/1999 | Mitsubori | |
| 6,435,832 | B1 | 8/2002 | Fasano | |
| 6,481,917 | B1 | 11/2002 | Chen et al. | |
| 6,896,479 | B1 * | 5/2005 | Svihla et al. | 415/104 |

FOREIGN PATENT DOCUMENTS

| | | |
|---|---|---|
| DE | 14 53 784 | 2/1969 |
| GB | 2 179 120 | 2/1987 |

* cited by examiner

*Primary Examiner*—Edward K. Look
*Assistant Examiner*—Devin Hanan
(74) *Attorney, Agent, or Firm*—The Webb Law Firm

(57) ABSTRACT

The impeller axial lock limits axial movement of an impeller disposed on a shaft. The impeller is spaced axially from a shaft sleeve disposed about the shaft. The impeller axial lock includes a ring member disposed about the shaft between the impeller and shaft sleeve. The ring member has a body defining a first engagement tab engaging the impeller, a second engagement tab engaging the shaft, and a third engagement tab engaging the shaft sleeve. The shaft sleeve secures the ring member to the shaft via the third engagement tab such that the ring member limits axial movement of the impeller on the shaft during rotation of the impeller. The second engagement tab engages a groove in the shaft, and the third engagement tab engages a groove in the shaft sleeve.

24 Claims, 4 Drawing Sheets

IMPELLER LOCK ASSEMBLY AND METHOD

BACKGROUND OF THE INVENTION

1. Field of the Invention

The present invention relates generally to rotating turbomachinery, such as turbochargers, and, more particularly, to an improved arrangement for mounting and securing an impeller wheel of such turbomachinery to a rotating shaft and limiting axial movement of the impeller wheel on the shaft during operation of the turbomachine.

2. Description of Related Art

In rotating turbomachinery such as turbochargers, impeller wheels are mounted to a rotating shaft, which is driven at high rotational speed. For example, a diesel engine turbocharger typically includes a turbine which drives a shaft and a compressor mounted for rotation on the shaft opposite the turbine wheel. The compressor typically includes an impeller wheel mounted for rotation on the shaft. The impeller wheel is driven at high rotational speeds by the rotating shaft during operation of the turbocharger. Numerous mounting arrangements are known in the field of rotating turbomachinery, also referred to herein generally as turbomachinery, for mounting and/or securing an impeller wheel to a rotating shaft. A few examples of such mounting arrangements are discussed herein.

U.S. Pat. No. 6,481,917 to Chen et al. discloses an arrangement for mounting an impeller wheel, such as a turbine or compressor wheel, on a shaft. In the mounting arrangement disclosed by this patent, the impeller wheel is held in place on the shaft by a plurality of clamping rings. One of the clamping rings engages a recess in the hub of the impeller wheel, while a second clamping ring engages a similarly formed recess at the opposite end of the impeller wheel hub. The first clamping ring is held in place against the impeller wheel by a threaded nut and engages a plurality of Belleville spring washers.

U.S. Pat. No. 5,961,246 to Mitsubori discloses a simple coupling bushing for joining an impeller wheel to a shaft.

U.S. Pat. No. 5,163,816 to Goetzke et al. discloses another example of a mounting arrangement for mounting an impeller wheel on a drive shaft. The mounting arrangement disclosed by this patent includes a two-piece spacer which is used to secure the impeller wheel to the drive shaft. The drive shaft includes a journal. The two-piece spacer is provided between the journal and the impeller wheel. The two-piece spacer includes a flange member and an annular locking ring. The annular locking ring is disposed in a recess formed in the flange member, and between the flange member and the impeller wheel. The locking ring includes a projection that engages a recess in the impeller wheel. The projection engages a tubular sleeve provided between the impeller wheel and the shaft. The annular locking ring further engages spline recesses formed in the drive shaft.

U.S. Pat. No. 3,884,595 to Herrick discloses a further example of an impeller wheel and shaft mounting arrangement. In the mounting arrangement disclosed by this patent, the shaft is provided with a keyway which receives a key. A hub portion of the impeller wheel is also provided with a keyway, which receives the same key. The key prevents relative rotation between the impeller wheel and the shaft.

U.S. Pat. No. 2,960,939 to Buschhom et al. discloses a rotor attachment arrangement for centrifugal pumps. In the attachment arrangement disclosed by this patent, a locking ring is provided in an annular groove in a pump shaft. The locking ring extends into a recess formed in a shaft-protecting sleeve positioned about the pump shaft. The locking ring prevents movement of the pump shaft relative to the sleeve by engaging a shoulder formed in the sleeve and a key formed on the pump shaft.

While numerous attachment or mounting arrangements are known in the art for connecting an impeller wheel to a rotating shaft, a continuing need still exists in the field of rotating turbomachinery for improved impeller-shaft mounting or attachment methods, particularly those that are simple to manufacture and install in such rotating turbomachinery. A specific need exists for an improved mounting arrangement for mounting and/or securing an impeller wheel to a rotating shaft that will limit axial movement of the impeller wheel on the shaft, which occurs during operation of the turbomachine.

SUMMARY OF THE INVENTION

The foregoing needs are fulfilled by an impeller lock assembly including an impeller lock in accordance with the present invention. The impeller lock assembly is generally adapted to limit axial movement of an impeller on a shaft. The impeller is disposed about the shaft, and a shaft sleeve disposed about the shaft and spaced axially from the impeller. The impeller lock includes a ring member disposed about the shaft between the impeller and shaft sleeve. The ring member has a body defining a first engagement tab for engaging the impeller, a second engagement tab for engaging the shaft, and a third engagement tab for engaging the shaft sleeve. The shaft sleeve secures the ring member to the shaft via the third engagement tab, such that axial movement of the impeller on the shaft is limited during rotation of the impeller.

The second engagement tab may lie along a longitudinal axis of a transverse cross-section through the ring member. The third engagement tab may extend along an axis substantially perpendicular to the longitudinal axis. The first engagement tab may be formed as a hook with a prong, with the prong engaging the impeller. The prong may engage a mating hook defined by the impeller body.

The first engagement tab and the second engagement tab may be formed on an inner side of the ring member. An outer side of the ring member may be substantially planar. The outer side of the ring member may lie substantially coincident with outer surfaces of the shaft sleeve and impeller hub.

The ring member may be in the form of a split-ring member. The opposing sides of the ring member may abut the impeller and shaft sleeve, respectively. The second engagement tab may engage a groove in the shaft, and the third engagement tab may engage a groove in the shaft sleeve.

The present invention is further directed to a method of limiting axial movement of an impeller on a shaft. The method includes positioning a ring member about the shaft adjacent the impeller, the ring member having a body defining a first engagement tab for engaging the impeller, a second engagement tab for engaging the shaft, and a third engagement tab for engaging a shaft sleeve to be positioned about the shaft. The method generally further includes joining the ring member to the impeller and shaft, such that the first engagement tab engages the impeller and the second engagement tab engages the shaft. Additionally, the method includes joining the shaft sleeve to the shaft, such that the third engagement tab engages or is received by the shaft sleeve. The shaft sleeve secures the ring member to the shaft via the third engagement tab such that axial movement of the impeller on the shaft is limited during rotation of the impeller.

The first engagement tab may be formed as a hook with a prong, such that the prong engages the impeller when the ring member is joined to the impeller and shaft. The prong may engage a mating hook defined by the impeller body. The second engagement tab may engage a groove in the shaft, and the third engagement tab may engage a groove in the shaft sleeve.

Moreover, the present invention is a method of retrofitting an impeller-shaft connection for limiting axial movement of the impeller on the shaft. The method generally includes providing the impeller disposed about the shaft. The impeller-shaft connection typically further includes a shaft sleeve disposed about the shaft and spaced axially from the impeller. The method generally further includes removing the impeller and shaft sleeve from the shaft, forming respective grooves in the shaft and in the shaft sleeve, and replacing or remounting the impeller on the shaft. The ring member may then be positioned about the shaft adjacent the impeller. The ring member has a body defining a first engagement tab for engaging the impeller, a second engagement tab for engaging the shaft, and a third engagement tab for engaging the shaft sleeve. The method generally further includes joining the ring member to the impeller and shaft, such that the first engagement tab engages the impeller and the second engagement tab engages the groove in the shaft. Next, the shaft sleeve may be replaced or remounted on the shaft, such that the third engagement tab engages the groove in the shaft sleeve. The shaft sleeve thereby secures the ring member to the shaft via the third engagement, such that axial movement of the impeller on the shaft is limited during rotation of the impeller.

Further details and advantages of the present invention will become apparent when reading the detailed description herein, in conjunction with the drawings.

DETAILED DESCRIPTION OF THE INVENTION

Figure 1:
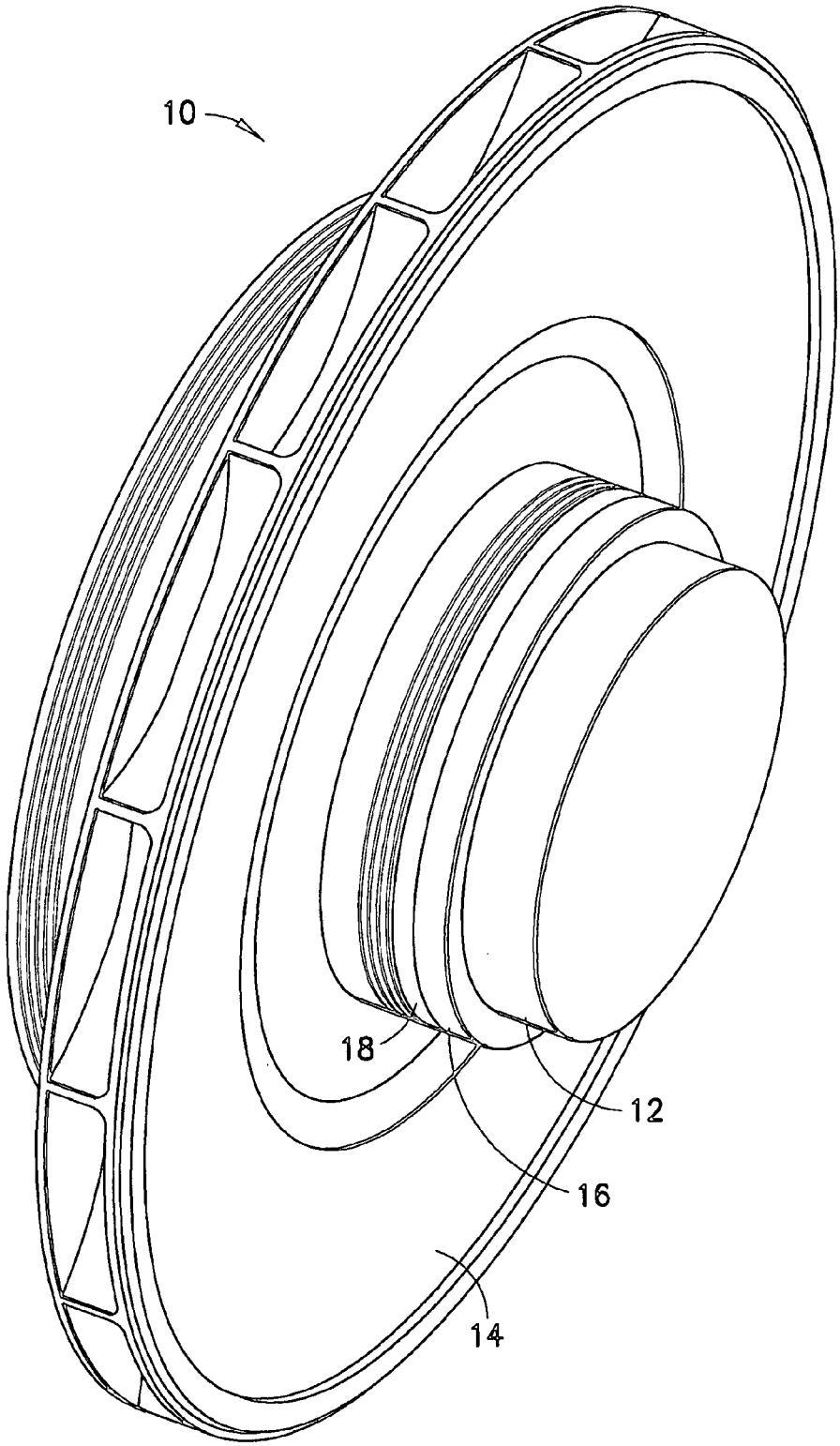
FIG. 1 is a perspective view of an impeller lock assembly in accordance with the present invention.

For purposes of the description hereinafter, the terms "upper", "lower", "right", "left", "vertical", "horizontal", "top", "bottom", and derivatives thereof, shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered limiting.

Figure 2:
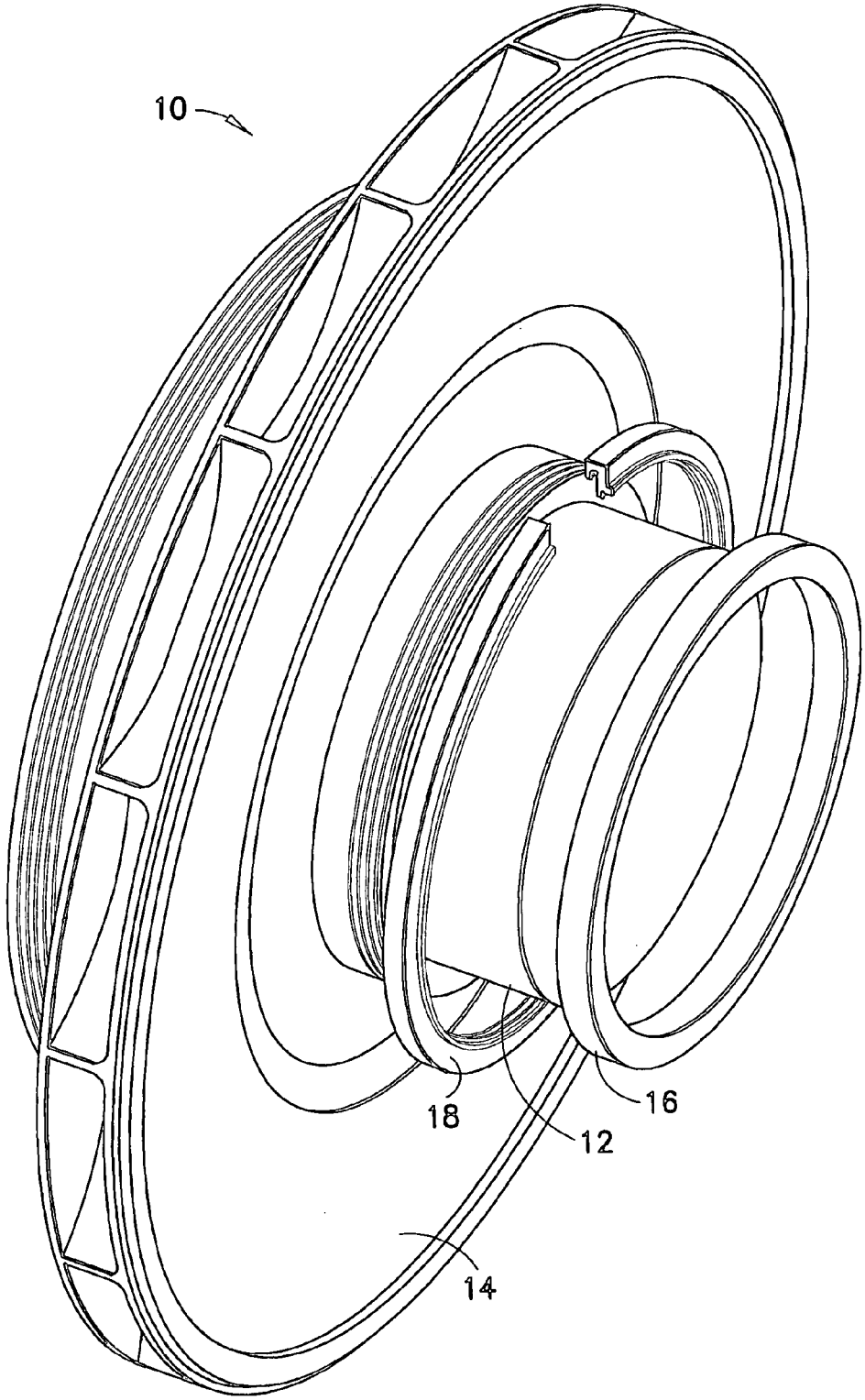
FIG. 2 is a perspective and partially-exploded view of the impeller lock assembly of FIG. 1, revealing an impeller wheel, shaft, shaft sleeve, and impeller lock of the assembly.

The present invention is generally directed to an arrangement or structure for securing an impeller wheel to a rotating shaft. Such an arrangement or structure is used in rotating turbomachinery such as turbochargers, wherein an impeller wheel is mounted to a rotating shaft driven at high speeds. Referring to FIGS. 1 and 2, an impeller lock assembly 10 of the present invention is shown. The impeller lock assembly 10 generally includes a shaft 12, such as a rotating shaft used to drive a compressor, an impeller wheel 14 (hereinafter "impeller 14"), and a shaft sleeve 16 disposed on the shaft 12 and spaced axially from the impeller 14. The impeller lock assembly 10 further includes an impeller lock 18 disposed on the shaft 12, generally between the impeller 14 and shaft sleeve 16.

The impeller lock 18 and shaft sleeve 16 are generally adapted to secure the impeller 14 to the shaft 12. In particular, the impeller lock 18 is provided on the shaft 12 to limit axial movement of the impeller 14 on the shaft 12, and the shaft sleeve 16 is adapted to secure the impeller lock 18 to the shaft 12. Such axial movement is caused by differences in gas pressure acting on the impeller 14 during operation of a rotating turbomachine, such as a compressor, incorporating the impeller 14. The forces generated by such gas pressure differences during operation of the rotating turbomachine cause the impeller 14 to move axially on the shaft 12. The impeller lock assembly 10 and impeller lock 18 of the present invention solve this problem by limiting the axial movement of the impeller 14 on the shaft 12.

Figure 3:
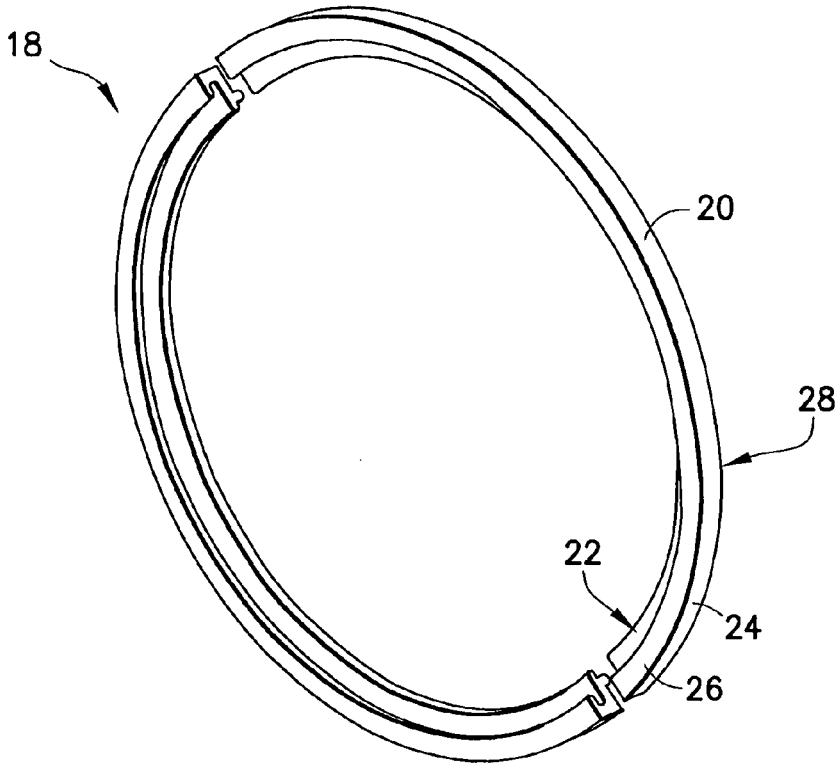
FIG. 3 is a perspective view of the impeller lock of the impeller lock assembly shown in FIGS. 1 and 2.
Figure 4:
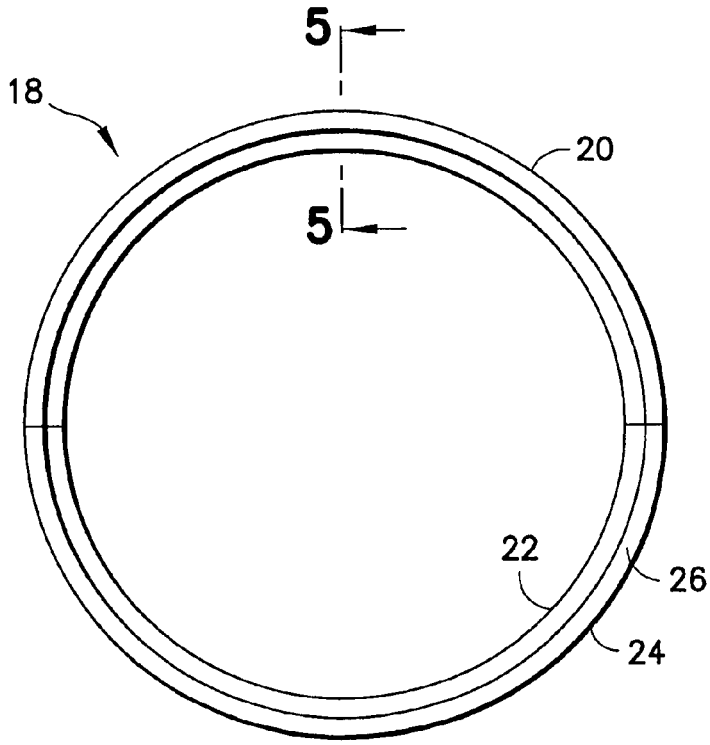
FIG. 4 is a front view of the impeller lock of the impeller lock assembly shown in FIGS. 1 and 2.
Figure 5:
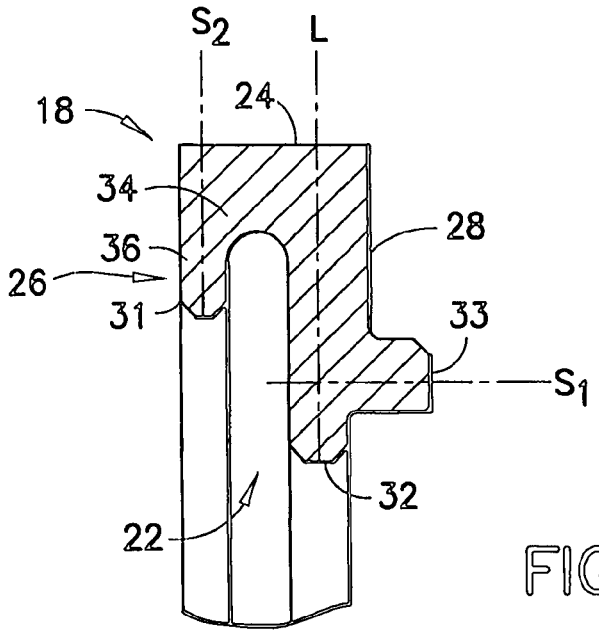
FIG. 5 is a transverse cross-sectional view taken along lines 5—5 in FIG. 4.
Figure 6:
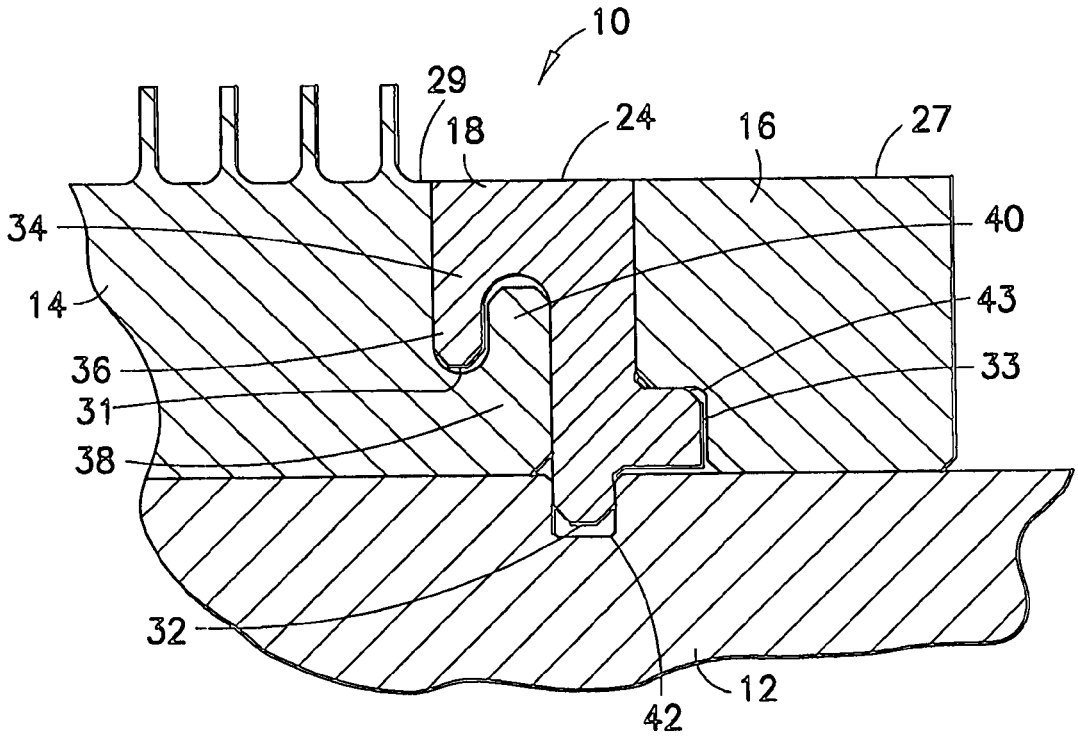
FIG. 6 is a detailed cross-sectional view showing the connection between the impeller wheel, shaft, and shaft sleeve, which is secured by the impeller lock of the present invention.

Referring to FIGS. 1–6, the impeller lock 18 is generally formed by a ring member 20, which is preferably a split-ring member as shown in FIG. 3. The ring member 20 includes an inner side 22 and an outer side 24. As shown in FIG. 6, the ring member 20 further includes opposing sides 26, 28 which are in contact with or abut the impeller 14 and the shaft sleeve 16, respectively. FIG. 6 further shows the impeller lock 18 and shaft sleeve 16 connecting and securing the impeller 14 to the shaft 12.

The body of the ring member 20 defines a plurality of engagement tabs for engaging the shaft 12, impeller 14, and shaft sleeve 16. In particular, the body of the ring member 20 defines a first, circumferential engagement tab 31 adapted to engage the impeller 14, a second, circumferential engagement tab 32 adapted to engage the shaft 12, and a third, circumferential engagement tab 33 adapted to engage the shaft sleeve 16. The shaft sleeve 16 cooperates with or engages the third engagement tab 33 to secure the ring member 20 comprising the impeller lock 18 to the shaft 12, such that axial movement of the impeller 14 on the shaft 12 is limited during rotation of the impeller 14 and shaft 12.

As shown in FIG. 6, the first and second engagement tabs 31, 32 are provided on the inner side 22 of the ring member 20, while the outer side 24 of the ring member 20 is formed to be substantially planar, and substantially coincident with an outer surface 27 of the shaft sleeve 16, and an outer surface 29 of the hub of the impeller 14, which is the portion of the impeller 14 that is fitted to the shaft 12 as is known in the art. FIGS. 5 and 6 further show that the first engagement tab 31 may be formed as a hook 34 with a prong 36. The prong 36 engages the impeller 14, as shown in FIG. 6. The hook 34 and prong 36 comprising the first engagement tab 31 preferably engage a mating hook 38 and prong 40 defined by the body of the impeller 14, to secure the impeller 14 to the shaft 12.

The body of the ring member 20 is preferably configured such that the second engagement tab 32 lies along a longitudinal axis L of a transverse cross-section through the ring member 20, as shown in FIG. 5. The third engagement tab 33 extends along an axis S1 oriented substantially perpendicular to the longitudinal axis L of the transverse cross-section. Further, as indicated previously, the first engagement tab 31 may be formed as a hook 34 with a prong 36 adapted to engage the impeller 14. The prong 36 of the first engagement tab 31 may extend along an axis S2 oriented substantially parallel to the longitudinal axis L of the transverse cross-section.

The first and second engagement tabs 31, 32 are generally adapted to engage the impeller 14 to the shaft 12, and limit axial movement of the impeller 14 relative to the shaft 12 when the shaft sleeve 16 is applied to the shaft 12 to secure the ring member 20 to the shaft 12. To secure the connection of the impeller 14 to the shaft 12, the second engagement tab 32 engages a circumferential groove 42 in the shaft 12, and the first engagement tab 31 engages the body of the impeller 14 in the manner discussed previously. Thus, with the first engagement tab 31 engaged with the body of the impeller 14, and the second engagement tab 32 engaged in the groove 42 in the shaft 12, the impeller 14 is mounted to the shaft 12 and limited in axial movement relative to the shaft 12, once the shaft sleeve 16 is applied to the shaft 12. As indicated previously, the shaft sleeve 16 is generally adapted to cooperate with or receive the third engagement tab 33, and secures the ring member 20 to the shaft 12 via the third engagement tab 33.

The third engagement tab 33 is shaped in a similar manner to the first and second engagement tabs 31, 32, and is specifically adapted to engage the shaft sleeve 16. In particular, the third engagement tab 33 engages or is received in a circumferential groove 43 defined in the shaft sleeve 16. The shaft sleeve 16 provides the radial force or pressure needed to maintain the ring member 20 of the impeller lock 18 engaged with the shaft 12 via the second engagement tab 32, which allows the impeller lock 18 to operate or function to limit the axial movement of the impeller 14 on the shaft 12 during operation of the impeller 14.

The steps for assembling the impeller lock assembly 10 of the present invention will now be discussed with continued reference to FIGS. 1–6. The impeller lock assembly 10 is assembled by first positioning the impeller 14 on the shaft 12. The impeller 14 may be shrunk-fit to the shaft 12 in a known manner in the art. Shrink-fitting is a known process in the art and relates to forming an interference fit between the hub of the impeller 14 and shaft 12. In particular, the shaft opening in the hub of the impeller 14 is purposely made smaller than the diameter of the shaft 12. The impeller 14 is then heated so that this opening is enlarged so that the impeller 14 may be fitted onto the shaft 12. Once the impeller 14 and hub thereof cool, the hub of the impeller 14 "shrinks" onto the shaft 12, forming an interference engagement therewith.

The impeller lock 18, preferably in the form of the split-ring ring member 20, is then positioned about the shaft 12, adjacent the impeller 14. The ring member 20 is preferably provided with a split-ring body so that the ring member 20 may be positioned about the shaft 12 without having to pass the ring member 20 over an end of the shaft 12. The ring member 20 is then engaged with the impeller 14 and shaft 12. Once the ring member 20 is engaged with the impeller 14 and shaft 12, the shaft sleeve 16 may then be positioned about the shaft 12 and used to secure the ring member 20 to the impeller 14 and shaft 12. In particular, the ring member 20 is joined or connected to the shaft 12, impeller 14, and shaft sleeve 16, such that the first engagement tab 31 engages the impeller 14, the second engagement tab 32 engages the groove 42 in the shaft 12, and the third engagement tab 32 engages the groove or recess 43 in the shaft sleeve 16. The shaft sleeve 16 may be shrunk-fit to the shaft 12 in the conventional manner described previously in connection with the impeller 14, and secures the overall connection between the ring member 20 and the impeller 14 and shaft 12. As discussed previously, the impeller lock 18, once installed, is adapted to limit the axial movement of the impeller 14 on the shaft 12 during operation of the turbomachine incorporating the impeller 14 and rotating shaft 12.

The impeller lock 18 may be connected to shaft 12, impeller 14, and shaft sleeve 16, such that the hook 34 of the first engagement tab 31 engages the corresponding hook 38 defined by the body of the impeller 14. In particular, the prong 36 of the first engagement tab 31 may be inserted into the hook 38 defined by the body of the impeller 14, such that the prong 36 coacts with or engages the prong 40 of the hook 38 defined by the body of the impeller 14. The shrunk-fit shaft sleeve 16 secures the hook 34 to hook 38 engagement, which is illustrated in FIG. 6.

The impeller lock 18 may be adapted to retrofit into an existing impeller-shaft connection for limiting axial movement of a previously-existing impeller on a pre-existing shaft. Assuming that the shaft 12, impeller 14, and shaft sleeve 16 are previously existing components found in a turbomachine such as a compressor, the impeller lock 18 may be adapted for use with such components by first removing the impeller 14 and shaft sleeve 16 from the shaft 12, and forming the circumferential groove 42 in the shaft 12 and the circumferential groove 43 in the shaft sleeve 16. Next, the impeller 14 is remounted onto the shaft 12. The impeller lock 18 is then applied to the remounted impeller 14 and the shaft 12 in the manner discussed previously. In particular, the ring member 20 is positioned about the shaft 12 such that the first engagement tab 31 engages the impeller 14 and the second engagement tab 32 engages the groove 42 in the shaft 12. The shaft sleeve 16 is then remounted to the shaft 12, such that the third engagement tab 33 is received in the groove 43 in the shaft sleeve 16. The impeller 14 and shaft sleeve 16 may be remounted to the shaft 12 by the conventional shrink-fitting process identified previously.

The impeller lock assembly 10 and impeller lock 18 of the present invention may be applied to any impeller-shaft connection in rotating turbomachinery, where it is desirable to limit axial movement of the impeller relative to the shaft during operation of such rotating turbomachinery. The impeller lock assembly 10 and impeller lock 18 have particular application in sleeveless impeller design, wherein an impeller is provided on a rotating shaft with nothing in front or behind the impeller to limit its axial movement on the shaft. The impeller lock 18 of the present invention may be incorporated into such sleeveless impeller configurations as a safety mechanism to prevent the impeller from moving on the shaft and potentially damaging other components of the rotating turbomachine into which the impeller is incorporated. Typically, such sleeveless impeller designs have the impeller shrink-fitted onto the shaft, which may be eliminated by application of the impeller lock assembly 10 and impeller lock 18 of the present invention.

While the present invention was described with reference to preferred embodiments of the impeller lock assembly and impeller lock, those skilled in the art may make modifications and alterations to the present invention without departing from the scope and spirit of the invention. Accordingly, the above detailed description is intended to be illustrative rather than restrictive. The invention is defined by the appended claims, and all changes to the invention that fall within the meaning and range of equivalency of the claims are to be embraced within their scope.

The invention claimed is:

1. An impeller lock for limiting axial movement of an impeller on a shaft, comprising:

a split ring member having a body defining a first engagement tab adapted to engage the impeller, a second engagement tab adapted to engage the shaft supporting the impeller, and a third engagement tab adapted to engage a shaft sleeve disposed about the shaft, when the ring member is positioned about the shaft and between the impeller and shaft sleeve.

2. The impeller lock of claim 1, wherein the second engagement tab lies along a longitudinal axis of a transverse cross-section through the ring member.

3. The impeller lock of claim 2, wherein the third engagement tab extends along an axis substantially perpendicular to the longitudinal axis.

4. An impeller lock for limiting axial movement of an impeller on a shaft, comprising:

a ring member having a body defining a first engagement tab adapted to engage the impeller, a second engagement tab adapted to engage the shaft supporting the impeller, and a third engagement tab adapted to engage a shaft sleeve disposed about the shaft, when the ring member is positioned about the shaft and between the impeller and shaft sleeve, wherein the first engagement tab is formed as a hook with a prong adapted to engage the impeller.

5. The impeller lock of claim 1, wherein the first engagement tab and the second engagement tab are formed on an inner side of the ring member.

6. An impeller lock for limiting axial movement of an impeller on a shaft, comprising:

a ring member having a body defining a first engagement tab adapted to engage the impeller, a second engagement tab adapted to engage the shaft supporting the impeller, and a third engagement tab adapted to engage a shaft sleeve disposed about the shaft, when the ring member is positioned about the shaft and between the impeller and shaft sleeve, wherein the first engagement tab and the second engagement tab are formed on an inner side of the ring member, wherein an outer side of the ring member is substantially annular.

7. An impeller lock assembly for limiting axial movement of an impeller on a shaft, comprising:

the shaft;

the impeller disposed about the shaft; a shaft sleeve disposed about the shaft and spaced axially from the impeller; and a split ring member disposed about the shaft between the impeller and shaft sleeve, the ring member having a body defining a first engagement tab engaging the impeller, a second engagement tab engaging the shaft, and a third engagement tab engaging the shaft sleeve, the shaft sleeve securing the ring member to the shaft via the third engagement tab such that axial movement of the impeller on the shaft is limited during rotation of the impeller.

8. The impeller lock assembly of claim 7, wherein the second engagement tab lies along a longitudinal axis of a transverse cross-section through the ring member.

9. The impeller lock assembly of claim 8, wherein the third engagement tab extends along an axis substantially perpendicular to the longitudinal axis.

10. The impeller lock assembly of claim 7, wherein the first engagement tab and the second engagement tab are formed on an inner side of the ring member.

11. The impeller lock assembly of claim 7, wherein opposing sides of the ring member abut the impeller and shaft sleeve.

12. The impeller lock assembly of claim 7, wherein the third engagement tab engages a groove in the shaft sleeve.

13. An impeller lock assembly for limiting axial movement of an impeller on a shaft, comprising:

the shaft the impeller disposed about the shaft; a shaft sleeve disposed about the shaft and spaced axially from the impeller; and a ring member disposed about the shaft between the impeller and shaft sleeve, the ring member having a body defining a first engagement tab engaging the impeller, a second engagement tab engaging the shaft, and a third engagement tab engaging the shaft sleeve, the shaft sleeve securing the ring member to the shaft via the third engagement tab such that axial movement of the impeller on the shaft is limited during rotation of the impeller, wherein the first engagement tab is formed as a hook with a prong engaging the impeller.

14. The impeller lock assembly of claim 13, wherein the prong engages a mating hook defined by the impeller body.

15. An impeller lock assembly for limiting axial movement of an impeller on a shaft, comprising:

the shaft;

the impeller disposed about the shaft; a shaft sleeve disposed about the shaft and spaced axially from the impeller; and a ring member disposed about the shaft between the impeller and shaft sleeve, the ring member having a body defining a first engagement tab engaging the impeller, a second engagement tab engaging the shaft, and a third engagement tab engaging the shaft sleeve, the shaft sleeve securing the ring member to the shaft via the third engagement tab such that axial movement of the impeller on the shaft is limited during rotation of the impeller, wherein the first engagement tab and the second engagement tab are formed on an inner side of the ring member and, wherein an outer side of the ring member is substantially annular.

16. The impeller lock assembly of claim 15, wherein the outer side of the ring member lies substantially coincident with outer surfaces of the shaft sleeve and impeller hub.

17. An impeller lock assembly for limiting axial movement of an impeller on a shaft, comprising:

the shaft;

the impeller disposed about the shaft; a shaft sleeve disposed about the shaft and spaced axially from the impeller; and a ring member disposed about the shaft between the impeller and shaft sleeve, the ring member having a body defining a first engagement tab engaging the impeller, a second engagement tab engaging the shaft, and a third engagement tab engaging the shaft sleeve, the shaft sleeve securing the ring member to the shaft via the third engagement tab such that axial movement of the impeller on the shaft is limited during rotation of the impeller, wherein the second engagement tab engages a groove in the shaft, and the third engagement tab engages a groove in the shaft sleeve.

18. An impeller lock assembly for limiting axial movement of an impeller on a shaft, comprising:

the shaft;

the impeller disposed about the shaft; a shaft sleeve disposed about the shaft and spaced axially from the impeller; and a ring member disposed about the shaft between the impeller and shaft sleeve, the ring member having a body defining a first engagement tab engaging the impeller, a second engagement tab engaging the shaft, and a third engagement tab engaging the shaft sleeve, the shaft sleeve securing the ring member to the shaft via the third engagement tab such that axial movement of the impeller on the shaft is limited during rotation of the impeller, wherein the second engagement tab engages a groove in the shaft.

19. A method of limiting axial movement of an impeller on a shaft, comprising:

positioning a split ring member about the shaft adjacent the impeller, the ring member having a body defining a first engagement tab for engaging the impeller, a second engagement tab for engaging the shaft, and a third engagement tab for engaging a shaft sleeve to be disposed about the shaft;

joining the ring member to the impeller and shaft, such that the first engagement tab engages the impeller and the second engagement tab engages the shaft; and joining the shaft sleeve to the shaft, such that the third engagement tab engages the shaft sleeve, the shaft sleeve securing the ring member to the shaft via the third engagement tab such that axial movement of the impeller on the shaft is limited during operation of the impeller.

20. The method of claim 19, wherein the third engagement tab engages a groove in the shaft sleeve.

21. A method of limiting axial movement of an impeller on a shaft, comprising:

positioning a ring member about the shaft adjacent the impeller, the ring member having a body defining a first engagement tab for engaging the impeller, a second engagement tab for engaging the shaft, and a third engagement tab for engaging a shaft sleeve to be disposed about the shaft;

joining the ring member to the impeller and shaft, such that the first engagement tab engages the impeller and the second engagement tab engages the shaft; and joining the shaft sleeve to the shaft, such that the third engagement tab engages the shaft sleeve, the shaft sleeve securing the ring member to the shaft via the third engagement tab such that axial movement of the impeller on the shaft is limited during operation of the impeller, wherein the first engagement tab is formed as a hook with a prong, such that the prong engages the impeller when the ring member is joined to the impeller and shaft.

22. The method of claim 21, wherein the prong engages a mating hook defined by the impeller body.

23. A method of limiting axial movement of an impeller on a shaft, comprising:

positioning a ring member about the shaft adjacent the impeller, the ring member having a body defining a first engagement tab for engaging the impeller, a second engagement tab for engaging the shaft, and a third engagement tab for engaging a shaft sleeve to be disposed about the shaft;

joining the ring member to the impeller and shaft, such that the first engagement tab engages the impeller and the second engagement tab engages the shaft; and joining the shaft sleeve to the shaft, such that the third engagement tab engages the shaft sleeve, the shaft sleeve securing the ring member to the shaft via the third engagement tab such that axial movement of the impeller on the shaft is limited during operation of the impeller, wherein the second engagement tab engages a groove in the shaft.

24. A method of retrofitting an impeller-shaft connection for limiting axial movement of the impeller on the shaft, comprising:

providing the impeller disposed about the shaft, the impeller-shaft connection further including a shaft sleeve disposed about the shaft and spaced axially from the impeller;

removing the impeller and shaft sleeve from the shaft; forming respective grooves in the shaft and in the shaft sleeve;

replacing the impeller on the shaft;

positioning a ring member about the shaft adjacent the impeller, the ring member having a body defining a first engagement tab for engaging the impeller, a second engagement tab for engaging the shaft, and a third engagement tab for engaging the shaft sleeve;

joining the ring member to the impeller and shaft, such that the first engagement tab engages the impeller and the second engagement tab engages the groove in the shaft; and replacing the shaft sleeve on the shaft, such that the third engagement tab engages the groove in the shaft sleeve, the shaft sleeve securing the ring member to the shaft via the third engagement tab such that axial movement of the impeller on the shaft is limited during operation of the impeller.

* * * * *